US006931969B2

(12) United States Patent
Hsien

(10) Patent No.: US 6,931,969 B2
(45) Date of Patent: Aug. 23, 2005

(54) ADJUSTABLE SPANNER HAVING A TORQUE DETECTION FUNCTION

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/684,154

(22) Filed: Oct. 9, 2003

(65) Prior Publication Data

US 2005/0076753 A1 Apr. 14, 2005

(51) Int. Cl.[7] ..... B25B 23/142
(52) U.S. Cl. ..... 81/467; 81/468; 81/170
(58) Field of Search ..... 81/467, 60–63.2, 81/489, 125.1, 177.1, 170, 468; 72/20.1

(56) References Cited

U.S. PATENT DOCUMENTS 1,793,714 A * 2/1931 Newberg ..... 81/125.1
4,006,629 A * 2/1977 Barrett et al. ..... 73/862.26
4,522,075 A * 6/1985 Pohl ..... 73/862.23
4,651,597 A * 3/1987 Yang ..... 81/77
4,709,182 A * 11/1987 Wenske et al. ..... 310/316.01
5,158,096 A * 10/1992 Clark et al. ..... 600/590
5,557,994 A * 9/1996 Nakayama ..... 81/478
5,617,766 A * 4/1997 Tsuji et al. ..... 81/480
6,016,723 A * 1/2000 Hillinger ..... 81/63.1
6,119,562 A * 9/2000 Jenkins ..... 81/479
6,305,249 B1 * 10/2001 Wang ..... 81/63
6,634,260 B1 * 10/2003 Smith ..... 81/57.36
2001/0037550 A1 * 11/2001 Shoberg ..... 29/407.03
2002/0139201 A1 * 10/2002 Fanguy ..... 73/862.21
2003/0229344 A1 * 12/2003 Dycus et al. ..... 606/51
2004/0003683 A1 * 1/2004 Rudduck ..... 81/52

FOREIGN PATENT DOCUMENTS

FR 2626514 A1 * 8/1989 ..... B25B/23/14

* cited by examiner

*Primary Examiner*—David B. Thomas

(57) ABSTRACT

A adjustable spanner includes a main body having a first end formed with a handle portion and a second end formed with a drive portion having a fixed jaw, a movable jaw movably mounted on the drive portion relative to the fixed jaw, and a torque detection device mounted on the main body to detect a torque of the adjustable spanner. Thus, the torque detection device is mounted on the connection of the handle portion and the drive portion having a smaller structural strength, so that the torque detection device can detect the torque of the adjustable spanner exactly and sensitively.

4 Claims, 5 Drawing Sheets

ADJUSTABLE SPANNER HAVING A TORQUE DETECTION FUNCTION

BACKGROUND OF THE INVENTION

1. Field of the Invention

The present invention relates to an adjustable spanner having a torque detection function, and more particularly to an adjustable spanner having a torque detection device that is mounted on the connection of the handle portion and the drive portion having a smaller structural strength, so that the torque detection device can detect the torque of the adjustable spanner exactly and sensitively.

2. Description of the Related Art

A conventional adjustable spanner comprises a main body having a first end formed with a handle portion and a second end formed with a drive portion having a fixed jaw and a slideway, an adjustment screw rotatably mounted in the main body, and a movable jaw movably mounted on the drive portion and having a bottom formed with a rack slidably mounted in the slideway and engaged with the adjustment screw. Thus, the rack of the movable jaw is moved by rotation of the adjustment screw, so that the movable jaw is moved relative to the fixed jaw. Thus, the user's one hand can hold the handle portion to rotate the drive portion so as to rotate a screw member on a workpiece.

However, the connection of the handle portion and the drive portion has a smaller structural strength, so that the conventional adjustable spanner is easily deformed or broken at the connection of the handle portion and the drive portion due to an excessive torque.

SUMMARY OF THE INVENTION

The primary objective of the present invention is to provide an adjustable spanner having a torque detection function.

Another objective of the present invention is to provide an adjustable spanner, wherein the torque detection device is mounted on the connection of the handle portion and the drive portion having a smaller structural strength, so that the torque detection device can detect the torque of the adjustable spanner exactly and sensitively.

A further objective of the present invention is to provide an adjustable spanner, wherein the indication unit is connected to the strain gauges to indicate the detected torque values of the adjustable spanner in a digital manner.

A further objective of the present invention is to provide an adjustable spanner, wherein the indication unit is provided with adjusting knobs to switch the torque values detected by the strain gauge located at the connection of the handle portion and the drive portion and the strain gauge located at the drive portion, so that the user can obtain the detected torque values of the adjustable spanner exactly.

A further objective of the present invention is to provide an adjustable spanner, wherein the torque detection device is mounted on the bent portion having a smaller structural strength, so that the torque detection device can detect the torque of the adjustable spanner exactly and sensitively.

In accordance with the present invention, there is provided an adjustable spanner, comprising a main body having a first end formed with a handle portion and a second end formed with a drive portion having a fixed jaw, and a movable jaw movably mounted on the drive portion relative to the fixed jaw, wherein:

the adjustable spanner further comprises a torque detection device mounted on the main body to detect a torque of the adjustable spanner.

Further benefits and advantages of the present invention will become apparent after a careful reading of the detailed description with appropriate reference to the accompanying drawings.

DETAILED DESCRIPTION OF THE INVENTION

Figure 1:
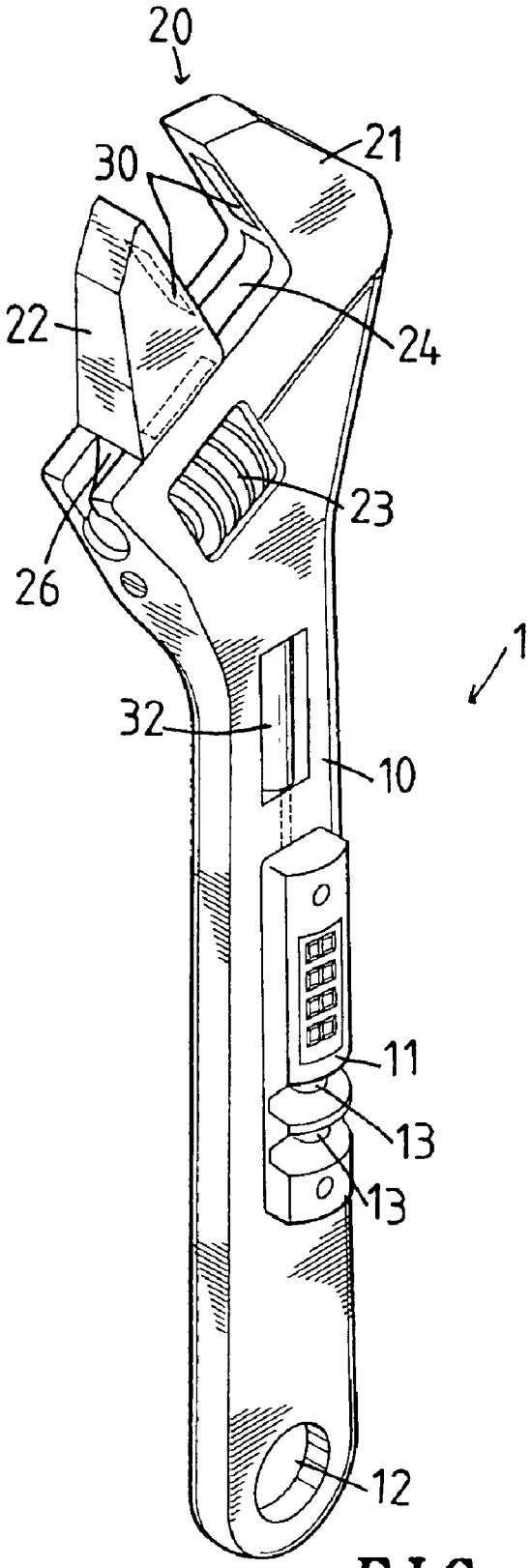
FIG. 1 is a perspective view of an adjustable spanner in accordance with the preferred embodiment of the present invention.
Figure 2:
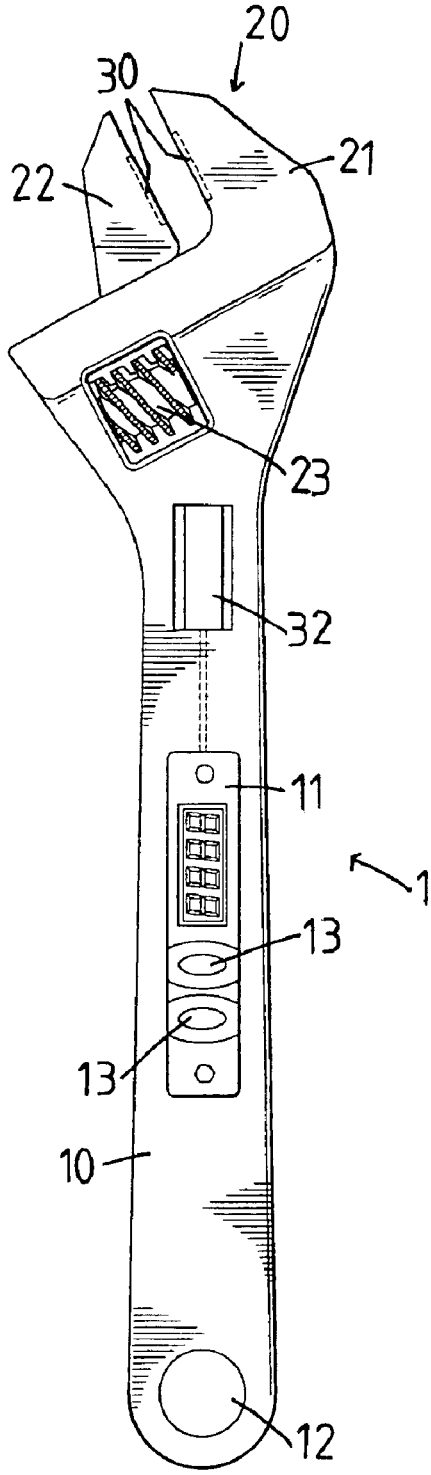
FIG. 2 is a front plan view of the adjustable spanner as shown in FIG. 1.

Referring to the drawings and initially to FIGS. 1 and 2, an adjustable spanner having a torque detection function in accordance with the preferred embodiment of the present invention comprises a main body 1 having a first end formed with a handle portion 10 and a second end formed with a drive portion 20 having a fixed jaw 21 and a slideway 24 located adjacent to the fixed jaw 21, an adjustment screw 23 rotatably mounted in the main body 1, and a movable jaw 22 movably mounted on the drive portion 20 and having a bottom formed with a rack 26 slidably mounted in the slideway 24 of the drive portion 20 and engaged with the adjustment screw 23. Thus, the rack 26 of the movable jaw 22 is moved by rotation of the adjustment screw 23, so that the movable jaw 22 is moved relative to the fixed jaw 21. In addition, the handle portion 10 has a distal end formed with a through hole 12 for hanging the main body 1.

The adjustable spanner further comprises a torque detection device mounted on the main body 1 to detect the torque of the adjustable spanner when the adjustable spanner is used to operate a screw member.

The torque detection device includes two opposite strain gauges 30 mounted on an inner side of the fixed jaw 21 and an inner side of the movable jaw 22 respectively, and a strain gauge 32 mounted on a connection of the handle portion 10 and the drive portion 20.

In such a manner, the torque detection device is mounted on the drive portion 20 that directly contacts the screw member and is mounted on the connection of the handle portion 10 and the drive portion 20 having a smaller structural strength, so that the torque detection device can detect the torque of the adjustable spanner exactly and sensitively.

The torque detection device further includes an indication unit 11 mounted on the handle portion 10 and connected to the strain gauges 30 and 32 to indicate the detected torque values of the adjustable spanner in a digital manner.

The indication unit 11 is provided with two adjusting knobs 13 to switch the torque values detected by the strain gauges 30 and 32, so that the user can obtain the detected torque values of the adjustable spanner exactly.

Figure 3:
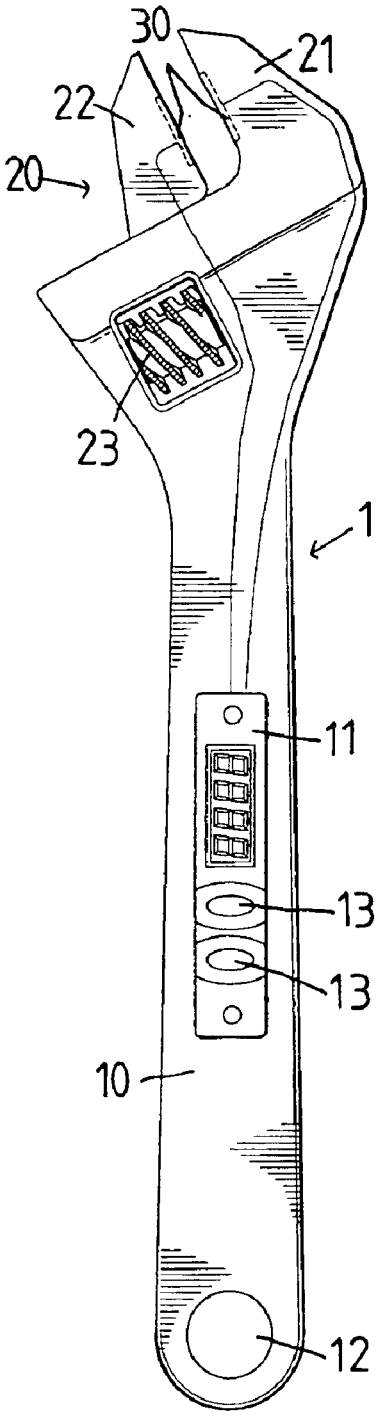
FIG. 3 is a front plan view of an adjustable spanner in accordance with another embodiment of the present invention.

Referring to FIG. 3, an adjustable spanner having a torque detection function in accordance with another embodiment of the present invention is shown, wherein the strain gauge 32 mounted on the connection of the handle portion 10 and the drive portion 20 is undefined.

Figure 4:
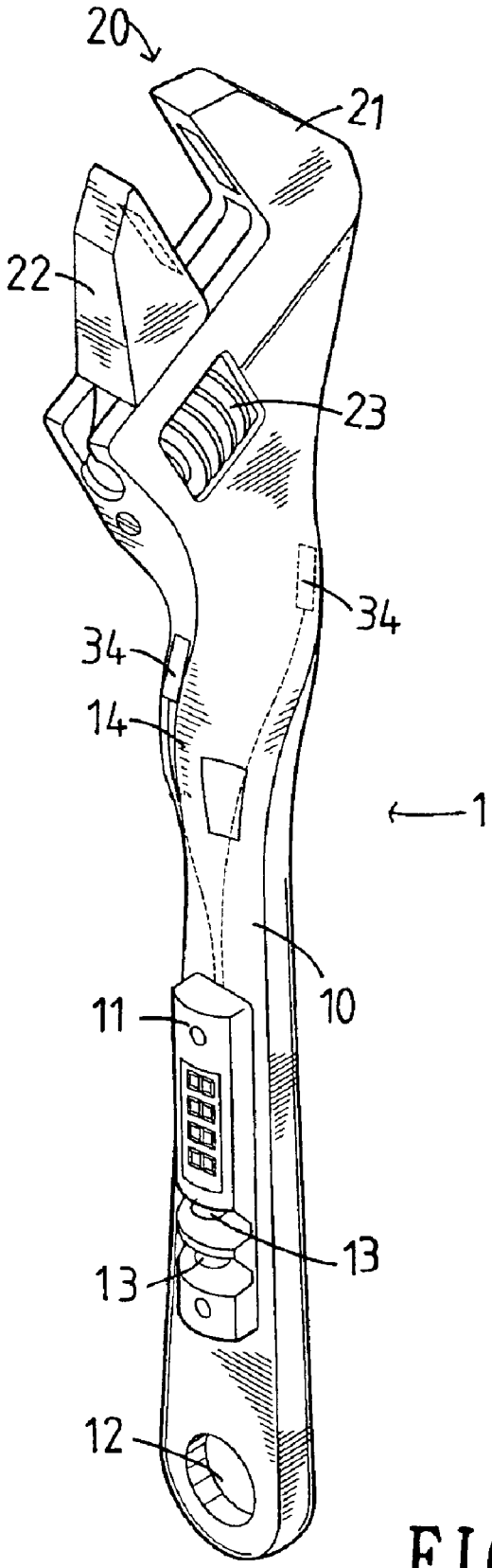
FIG. 4 is a perspective view of an adjustable spanner in accordance with another embodiment of the present invention.

Referring to FIG. 4, an adjustable spanner having a torque detection function in accordance with another embodiment of the present invention is shown, wherein the main body 1 has a bent portion 14 formed on the connection of the handle portion 10 and the drive portion 20. Preferably, the bent portion 14 is bent at a right angle. The torque detection device further includes two opposite strain gauges 34 respectively mounted on two sides of the bent portion 14 having a smaller structural strength, so that the torque detection device can detect the torque of the adjustable spanner exactly and sensitively.

Figure 5:
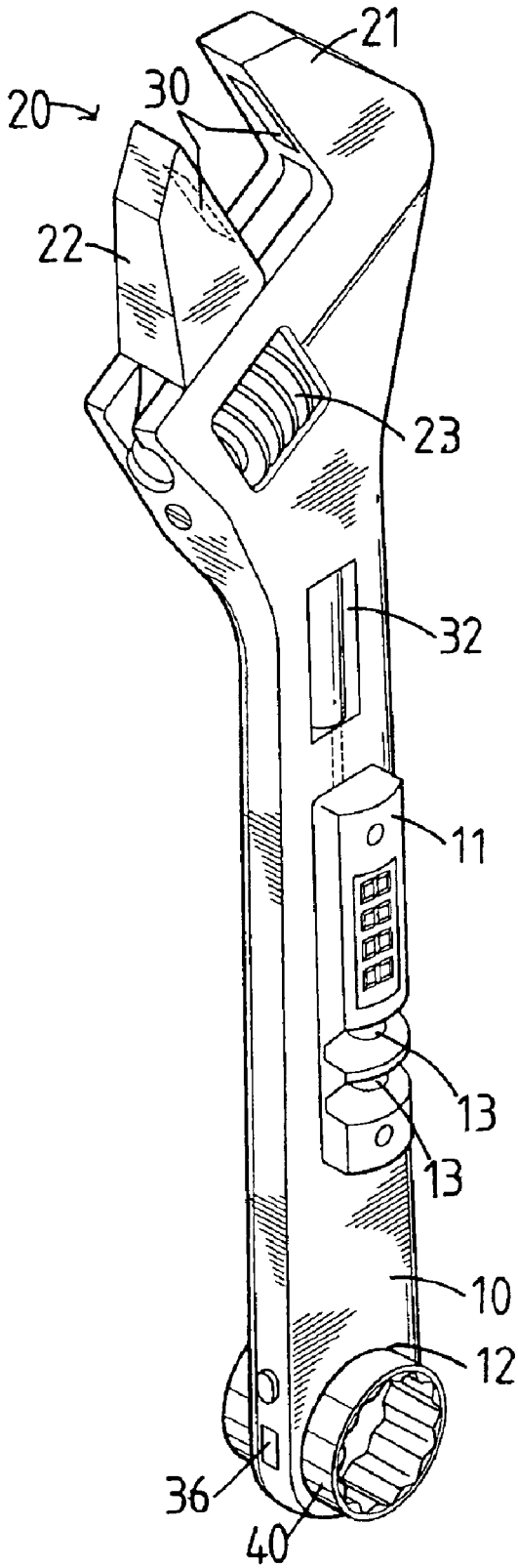
FIG. 5 is a perspective view of an adjustable spanner in accordance with another embodiment of the present invention.

Referring to FIG. 5, an adjustable spanner having a torque detection function in accordance with another embodiment of the present invention is shown, wherein the adjustable spanner further comprises a ratchet wheel 40 mounted in the through hole 12 of the handle portion 10. The torque detection device further includes a strain gauge 36 mounted on the distal end of the handle portion 10 and located adjacent to the ratchet wheel 40.

Figure 6:
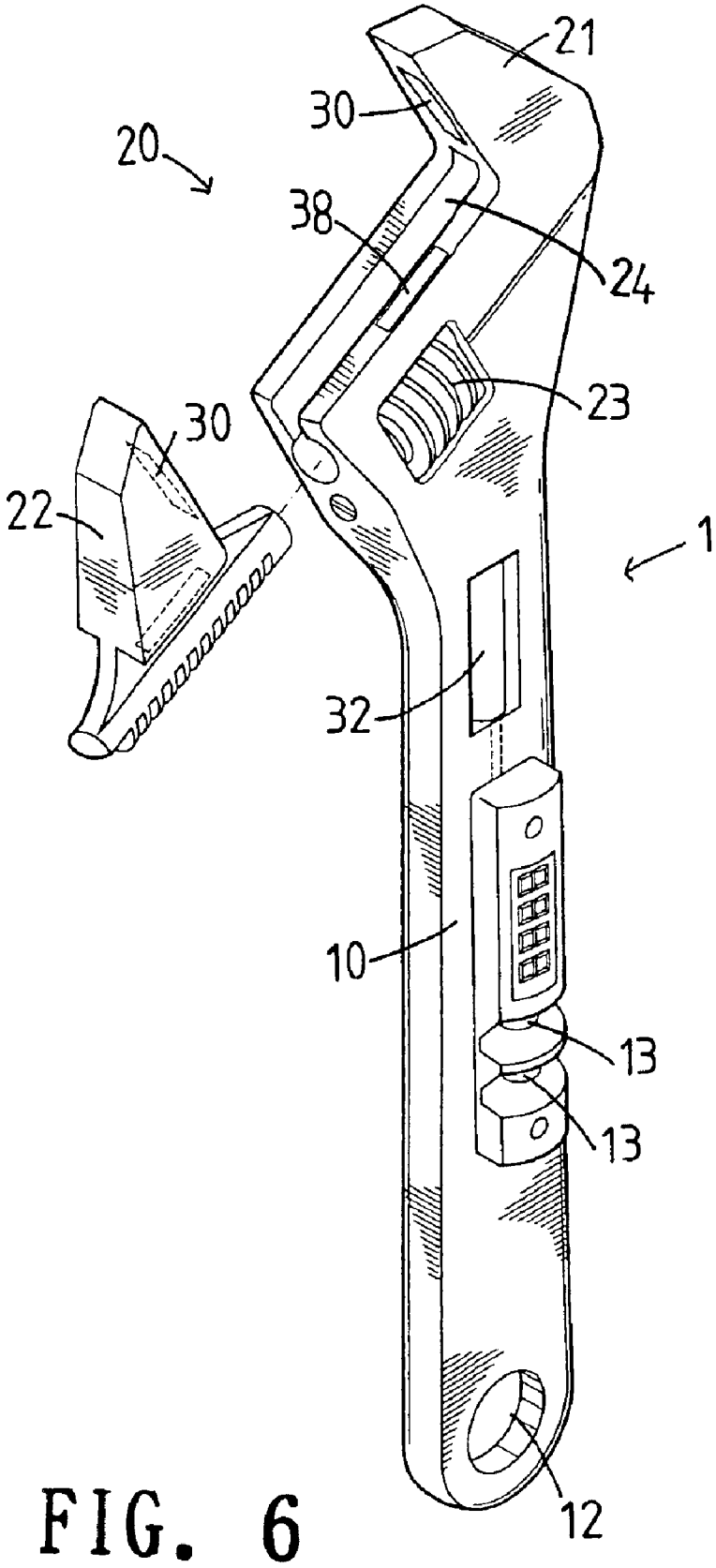
FIG. 6 is a partially exploded perspective view of an adjustable spanner in accordance with another embodiment of the present invention.

Referring to FIG. 6, an adjustable spanner having a torque detection function in accordance with another embodiment of the present invention is shown, wherein the torque detection device further includes a strain gauge 38 mounted on a wall of the slideway 24 of the drive portion 20.

Accordingly, the torque detection device is mounted on the connection of the handle portion 10 and the drive portion 20 having a smaller structural strength, so that the torque detection device can detect the torque of the adjustable spanner exactly and sensitively. In addition, the indication unit 11 is connected to the strain gauges to indicate the detected torque values of the adjustable spanner in a digital manner. Further, the indication unit 11 is provided with adjusting knobs 13 to switch the torque values detected by the strain gauge located at the connection of the handle portion 10 and the drive portion 20 and the strain gauge located at the drive portion 20, so that the user can obtain the detected torque values of the adjustable spanner exactly. Further, the torque detection device is mounted on the bent portion 14 having a smaller structural strength, so that the torque detection device can detect the torque of the adjustable spanner exactly and sensitively.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adjustable spanner, comprising a main body having a first end formed with a handle portion and a second end with a drive portion having a fixed jaw, and a movable jaw movably mounted on the drive portion relative to the fixed jaw, the movement of the movable jaw being not along an axial line of the handle portion, wherein the adjustable spanner further comprise a torque detection device mounted on the main body to detect a torque of the adjustable spanner;

wherein the torque detection device includes two opposite first strain gauges mounted on and fitted into an inner side of the fixed jaw and an inner side of the movable jaw respectively and a second strain gauge mounted on the connection of the handle portion and the drive portion;

wherein the torque detection device includes an indication unit mounted on the handle portion and connected to the strain gauges to indicate the detected torque values of the adjustable spanner in a digital manner; and wherein the indication unit is provided with two adjusting knobs to switch torque values detected by the first strain gauges and the second strain gauges so as to obtain the detected torque values of the adjustable spanner exactly.

2. The adjustable spanner in accordance with the claim 1, wherein the main body is twisted around an longitudinal axis of the handle portion so as to form a bent portion formed at a connection of the handle portion and the drive portion;

wherein the bent portion is bent at a right angle;

wherein the torque detection device is mounted on the bent portion; and wherein the torque detection device includes two opposite strain gauge respectively mounted on the two sides of the bent portion.

3. The adjustable spanner in accordance with the claim 1, wherein the drive portion has a slideway located adjacent to the fixed jaw, and the torque detection device includes a strain gauge selectively mounted on and fitted on a wall of the slideway of the drive portion.

4. The adjustable spanner in accordance with the claim 1, wherein the handle portion has a distal end formed with a through hole wherein a ratchet wheel is mounted in the through hole of the handle fitted into a side of the distal end of the handle portion and located adjacent to the ratchet wheel; and wherein the torque detection device includes a strain gauge selectively mounted on and fitted into a side of the distal end of the handle portion and located adjacent to the ratchet wheel.

* * * * *